US007513503B1

(12) United States Patent
Grewal et al.

(10) Patent No.: US 7,513,503 B1
(45) Date of Patent: Apr. 7, 2009

(54) METHOD FOR PLAYING MODIFIED GAME OF POKER

(76) Inventors: Manvir Singh Grewal, 3100 Pine Tree Rd., Lansing, MI (US) 48911; Gaggandeep Singh, 3120 Pinetree Rd., Lansing, MI (US) 48911

( * ) Notice: Subject to any disclaimer, the term of this patent is extended or adjusted under 35 U.S.C. 154(b) by 98 days.

(21) Appl. No.: 11/102,327

(22) Filed: Apr. 9, 2005

(51) Int. Cl.
*A63F 3/08* (2006.01)
*A63F 1/00* (2006.01)

(52) U.S. Cl. ..... 273/274; 273/292

(58) Field of Classification Search ..... 273/274
See application file for complete search history.

(56) References Cited

U.S. PATENT DOCUMENTS 5,294,128 A * 3/1994 Marquez ..... 273/292
5,380,012 A * 1/1995 Jones et al. ..... 273/292
5,489,101 A 2/1996 Moody
5,531,448 A 7/1996 Moody
5,607,161 A * 3/1997 Skratulia ..... 273/292
5,718,430 A 2/1998 Aramapakul et al.
5,901,958 A * 5/1999 Andrews ..... 273/292
6,042,118 A 3/2000 Poitra
6,206,373 B1 3/2001 Garrod
6,435,506 B1 * 8/2002 Piccoli ..... 273/292
6,517,072 B1 * 2/2003 McInerney ..... 273/292
6,637,747 B1 10/2003 Garrod
6,651,983 B1 11/2003 Chobanian
2002/0008356 A1 * 1/2002 De Keller ..... 273/292
2004/0259621 A1 * 12/2004 Pfeiffer et al. ..... 463/13
2005/0107148 A1 * 5/2005 Webb ..... 463/13
2005/0215326 A1 * 9/2005 Iosilevsky ..... 463/46

* cited by examiner

*Primary Examiner*—Gene Kim
*Assistant Examiner*—Alyssa M Hylinski
(74) *Attorney, Agent, or Firm*—Michael R. Kutas, Attorney, PLLC

(57) ABSTRACT

A method of playing a modified poker game includes the steps of providing a deck of playing cards and predetermining minimum wagers for each round of play. Players are dealt four hole cards and a community of four cards is established, 3 with their faces disposed toward the playing surface and one disposed with its face opposite the playing surface. A round of betting is held, at the conclusion of which one community card formerly with its face disposed toward the playing surface is disposed with its face opposite the playing surface. Another round of betting ensues. Successive rounds follow this pattern, until all community cards are disposed with their respective faces disposed opposite the playing surface. Utilizing the player's four hole cards and the four community cards, the player with the highest-ranking 5-card poker hand is declared the winner.

3 Claims, 4 Drawing Sheets

METHOD FOR PLAYING MODIFIED GAME OF POKER

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of the Invention

This invention relates generally to a poker styled card game, and more specifically to a poker styled card game wherein a player attempts to achieve a high ranking 5-card poker hand by utilizing four cards dealt to that player and four community cards.

2. Description of the Related Art

Currently, one of the most popular poker games played is a variation of poker called Texas Hold Em. In Texas Hold Em, each player is dealt two cards, with the face of the cards being disposed toward the playing surface, referred to as "hole cards." In a standard Texas Hold Em game, once each player has received their two hole cards, a round of betting occurs. In some games there are two compulsory bets at the commencement of the first round of play: the person immediately to the left of the dealer must place a bet equal to one half of the minimum predetermined bet, referred to as the "blind" and the player immediately to the left of the blind must place a bet equal to the minimum predetermined bet for that round, referred to as the "big blind." Play proceeds around the table in a clockwise manner, with each player given the opportunity to either fold, call the bet of the big blind, or raise the big blind. Any player that has not folded is referred to as an "active player." Once all bets have been called, three cards are dealt with the face of these cards being disposed opposite the playing surface (referred to as "the flop") to establish the "community" cards (cards that each player can use to complete their poker hand). Another round of betting occurs, with each active player having the opportunity to fold, bet, raise a previous bet made in that round, or check. Once all bets have been called, a fourth community card (referred to as "the turn") is added to the community with the face of this card being disposed opposite the playing surface. Another round of betting commences. Again, once all bets are called, a fifth and final card (referred to as "the river") is dealt with its face being disposed opposite the playing surface. A final round of betting occurs. Once all bets have been called, the showdown occurs, wherein all active players reveal their hole cards to determine the winner of the game based upon the highest ranking 5 card poker hand created from the 5 community cards and that player's two hole cards. The winner typically receives the proceeds of the wagering, commonly referred to as "the pot."

There have been countless variations of poker, and more specifically, Texas Hold Em, which itself appears to be derived from 7 card stud poker. For example, U.S. Pat. No. 5,531,448 (Moody) describes a variation of Texas Hold Em wherein players attempt to make the highest 5-card poker hand out of a set of hole cards and a set of community cards.

In this variation, however, three hole cards are dealt to each player, and eight cards are dealt, some with their faces disposed opposite the playing surface, and some with their faces disposed toward the playing surface. These eight community cards are arranged in four groups of two cards with the community card layout being in the form of a directional compass with a pair of community cards at each point of the compass. The positioning of the pair of community cards on these respective points of the compass determine which, if any, of the cards in the respective pairs are disposed with their face toward or opposite the playing surface. Each player then can choose which pair of community cards he or she wished to utilize in completing their 5-card poker hand.

U.S. Pat. No. 5,489,101 (Moody) again describes a variation of Texas Hold Em, again with each player attempting to make the highest 5-card poker hand out of a set of hole cards and a set of community cards. In this variation each player is dealt 5 hole cards, with six cards being dealt with their face disposed toward the playing surface as the community. The community cards are arranged in a three row triangle pattern. A player may discard up to 5 of his or her hole cards. The dealer then positions the community cards with their faces disposed opposite the playing surface. Depending on how many hole cards a player discarded, predetermined cards in the community are used by that player to complete his or her 5-card poker hand.

U.S. Pat. No. 5,718,430 (Aramapakul, et al.) discloses a variation of Texas Hold Em wherein each player is dealt 3 hole cards. The player must discard one hole card. Five cards are then dealt with their faces disposed opposite the playing surface to serve as the community. These two hole cards and five community cards are then used to create a 5-card poker hand.

U.S. Pat. No. 6,042,188 (Poitra) discloses a variation wherein each player makes an initial wager prior to being dealt any hole cards. After this initial round of betting, each player is dealt two hole cards. Three cards are dealt, two with their faces disposed opposite the playing surface, and the remaining community card being disposed with its face disposed toward the playing surface, as the community cards. At this point, each player is given the opportunity to "double down." Following this opportunity, the showdown occurs and all bets are resolved in favor of the player having the highest 5-card poker hand.

Additionally, U.S. Pat. No. 6,651,983 (Chobanian) discloses a variation wherein each player initially is dealt 2 hole cards. A round of betting then occurs. Four community cards are then dealt with their faces disposed opposite the playing surface. Another round of betting occurs. Finally, each player is dealt one final hole card. A final round of betting takes place. Once all bets have been called, the showdown occurs, with the winner being that active player with the highest 5-card poker hand.

Among the deficiencies in the prior art is that the variations of Texas Hold Em involve complex instructions, which can intimidate the novice player. Additionally, a deficiency in the prior art is the limited number of hole cards utilized. When the number of hole cards is limited to two or three as seen in Texas Hold Em and its variations, the strategy of the game is limited, as a player has only to guess two cards of his or her opponent.

Thus, there is a need in the relevant art for a modified game of poker that provides a new variation of Texas Hold Em allowing for the inclusion of plurality of players that is easy to learn, is fast paced, and increases the skill necessary in determining the relative strength of a player's hand versus that of his or her opponent's.

BRIEF SUMMARY OF THE INVENTION

Accordingly, the present invention is a method for playing a modified game of poker. The method includes the steps of providing a standard deck of playing cards and a playing surface. Prior to play commencing, a minimum bet is set for each round. Each player is then dealt four hole cards from the deck, with the faces of these hole cards being disposed toward the playing surface, and four cards are arranged on the playing surface to form the community, with the face of one of the cards in the community disposed with its face opposite the playing surface, and the remaining three cards of the community disposed with their faces toward the playing surface. A first round of betting is then held. Once all bets have been called that round of betting concludes.

Play proceeds with each successive round including the steps of arranging the community with one additional community card positioned with its face disposed opposite the playing surface and a round of betting. Once all community cards have been disposed with their respective faces disposed opposite the playing surface and all wagers in the final round have been called, the game proceeds to the showdown.

All remaining active players disclose their hole cards and the active player with the highest-ranking 5-card poker hand is declared the winner.

An advantage of the method for playing a modified game of poker of the present invention is that it is easy to learn.

Another advantage of the method for playing a modified game of poker of the present invention is that it utilizes multiple hole cards, thereby increasing the skill level necessary to determine the relative strength of a player's hand.

Another advantage of the method for playing a modified game of poker of the present invention is that it is easily adaptable to a house-banked game.

An additional advantage of the method for playing a modified game of poker of the present invention is that it is easily adaptable to a player-banked game.

Yet another advantage of the method for playing a modified game of poker of the present invention is that the number of hole cards and community cards can be changed without otherwise altering the rules of play.

Other objects, features, and advantages of the present invention will become apparent from the following descriptions, taken in connection with the accompanying drawings, wherein, by way of illustration and example, an embodiment of the present invention is disclosed.

DETAILED DESCRIPTION OF THE PREFERRED EMBODIMENTS

Figure 1:
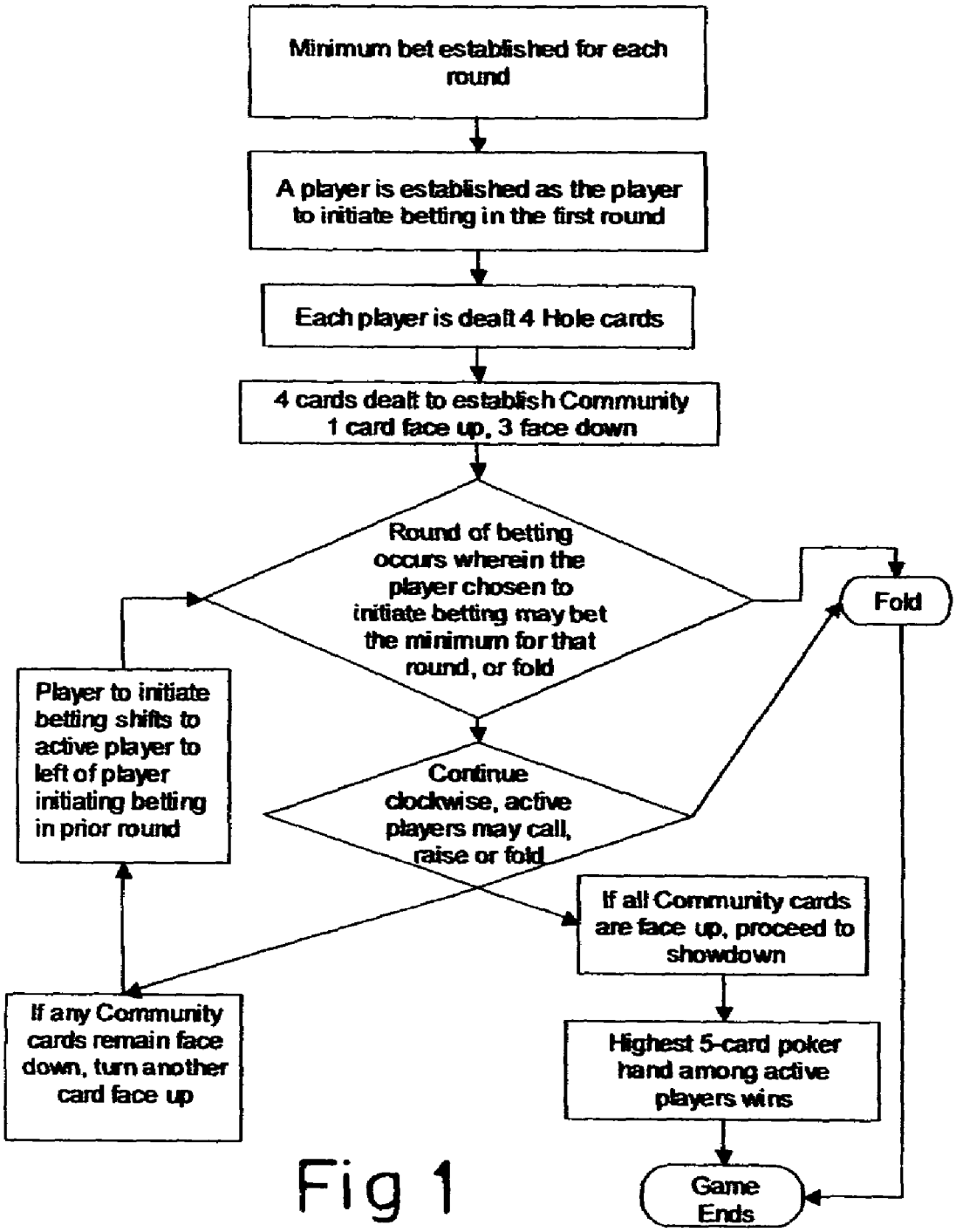
FIG. 1 is a block diagram representing the flow of play.

Referring to the drawings contained herein, there is shown in FIG. 1, a diagram that explains how the method of the present invention is performed. The diagram describes a poker styled card game wherein players utilize four hole cards and four community cards to form a 5-card poker hand with the winner of the game being that player at the end of play with the highest ranking 5-card poker hand. Conventional poker hand rankings are utilized with rank order being: Royal Flush, Straight Flush, Four-of-a-kind, Full House, Flush, Straight, Three-of-a-Kind, Two Pair, and One Pair.

Figure 2:
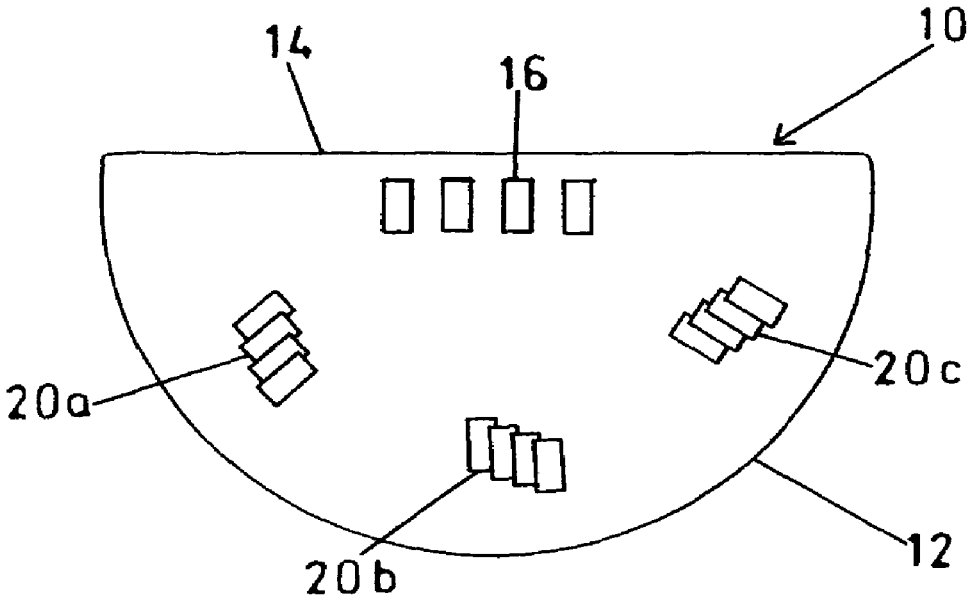
FIG. 2 is a plan view of a playing surface upon which a version of the game may be played.

FIG. 2 depicts a playing surface, generally indicated at 10, being a table or other planer surface, said playing surface 10 having one curved side 12, to accommodate a number of players, and one substantially straight side 14, to accommodate a dealer. However, it will be appreciated by those having ordinary skill in the art that said playing surface 10 may be of any appropriate size and shape. It will also be appreciated by those having ordinary skill in the art that said playing surface 10 may be adapted for any number of players and variations.

Positioned near the center of said playing surface 10 is established an area for receipt of said community cards 16. Along said curved side 12 of said playing surface 10 is located playing positions, 18*a*-18*c*, for the receipt of each player's hole cards. However, it will be appreciated by those having ordinary skill in the art that the layout on said playing surface 10 may be arranged in any manner suitable for play. Further, it will be appreciated by one having ordinary skill in the art that the number of players can be any number of players.

FIG. 1, details a game wherein a plurality of players play against one another with the player having the highest 5-card poker hand at the conclusion of the game winning the pot. One player is designated as the player that will initiate betting in the first round. A minimum bet is established for each round of play, with said minimum bet increased by a common multiplier or denomination to establish the minimum wager of successive rounds. One example would be where the minimum bet in each round is doubled from that of the proceeding round. Therefore, if the minimum wager in the first round of betting is established at $1, the minimum wager in the second round of betting would be $2, the minimum wager in the third round of betting would be $4, and the minimum wager in the final round of betting would be $8. Further, any raises in a round must be by denominations of that rounds minimum bet. However, it will be appreciated by those having ordinary skill in the art that said minimum wager or amount of a raise in any round can be established in any manner by either using some common factor or establishing a set dollar figure.

The game is played with a standard deck of 52 playing cards. However, it will be appreciated by those having ordinary skill in the art that various combinations of decks may be utilized in the present invention.

Figure 3:
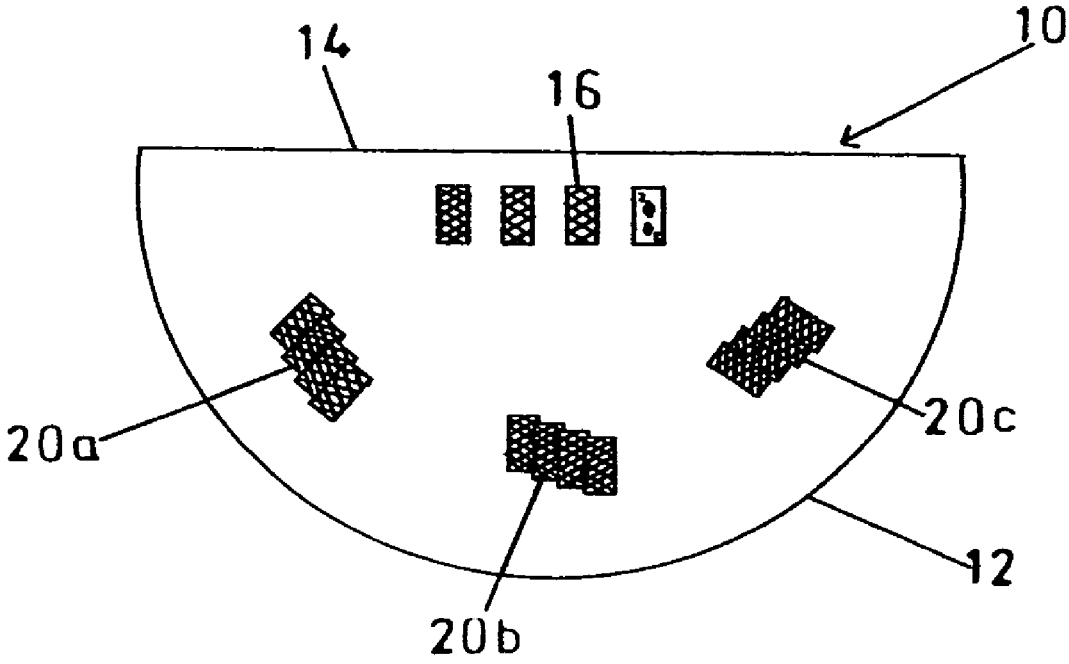
FIG. 3 is a plan view of a playing surface depicting the layout of a playing surface at the commencement of the first round of play.

FIG. 3 depicts a playing surface 10 during the first round of play in which each player is dealt four hole cards from the deck, each of said hole cards being disposed with their respective face disposed toward the playing surface 10. Four cards are then dealt and placed into the area established for the community 16. Three of said community cards are disposed with their respective faces toward the playing surface 10. The fourth said community card is disposed with its face opposite the playing surface 10. However, it will be appreciated by those having ordinary skill in the art that the present invention can be accomplished by utilizing any number of hole cards and community cards.

The player designated to initiate wagering may either place the minimum wager for the first round of betting, or fold. Play then continues in a clockwise manner around the table. If the person designated to initiate betting in the first round folds, the first player in turn wishing to stay in the game must place the minimum wager established for this round. Each successive player then has the options of calling the minimum wager or any raised wager in that round, raising the minimum wager or any other raised wager in that round, or folding by placing his or her hole cards with their respective faces disposed toward the playing surface, into the center of the table. Once all wagers have been called, the first round of play concludes. All players that have not folded in this round become active players in the next round. If all players but one has folded, that player is declared the winner of the game. If more than one active player remains, play proceeds to the next round.

Figure 4:
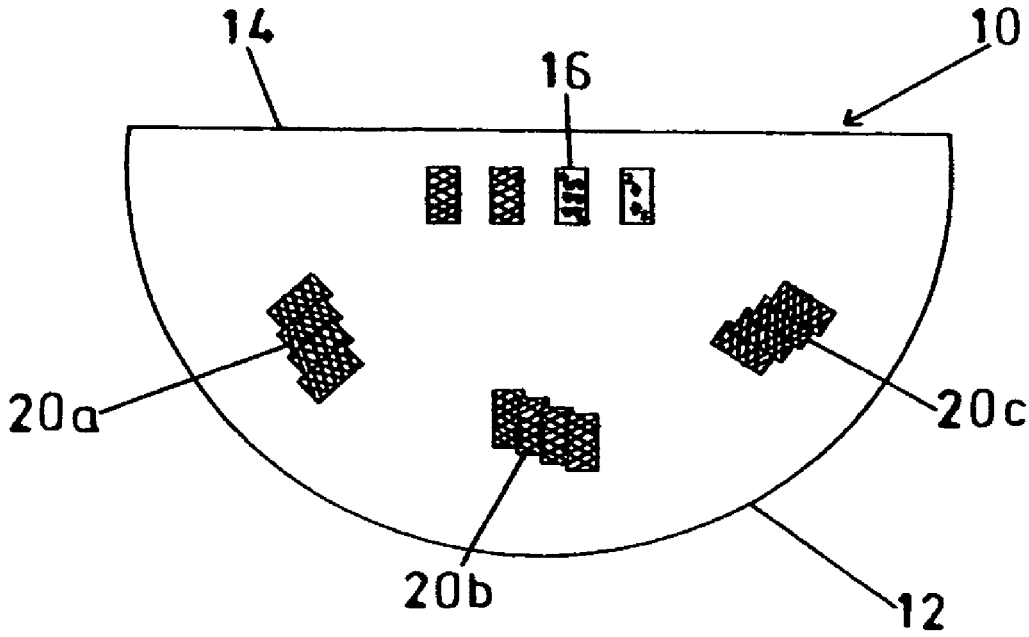
FIG. 4 is a plan view of a playing surface depicting the layout of a playing surface at the commencement of the second round of play.

FIG. 4 depicts a playing surface 10 at the commencement of the second round, wherein one of the community cards formerly with its face disposed toward the playing surface 10 in the last round is now positioned with its faces opposite the playing surface. The first active player to the left of the person placing the minimum bet in the prior round is designated as the person to initiate betting in the present round. If the person designated to initiate betting in this round folds, the first player in turn wishing to stay in the game must place the minimum wager established for this round. Play proceeds in a clockwise manner with each remaining active player in turn exercising the option to call the minimum wager or any raised wager in that round, raise the minimum wager or any other raised wager in that round, or fold by placing his or her hole cards with the respective faces disposed toward the playing surface, into the center of the playing surface 10. Once all wagers have been called in this round, the round of play concludes. If only one active player remains at the end of this round, that player is declared the winner of the game. If more than 1 active player remains, play proceeds to the third round.

Figure 5:
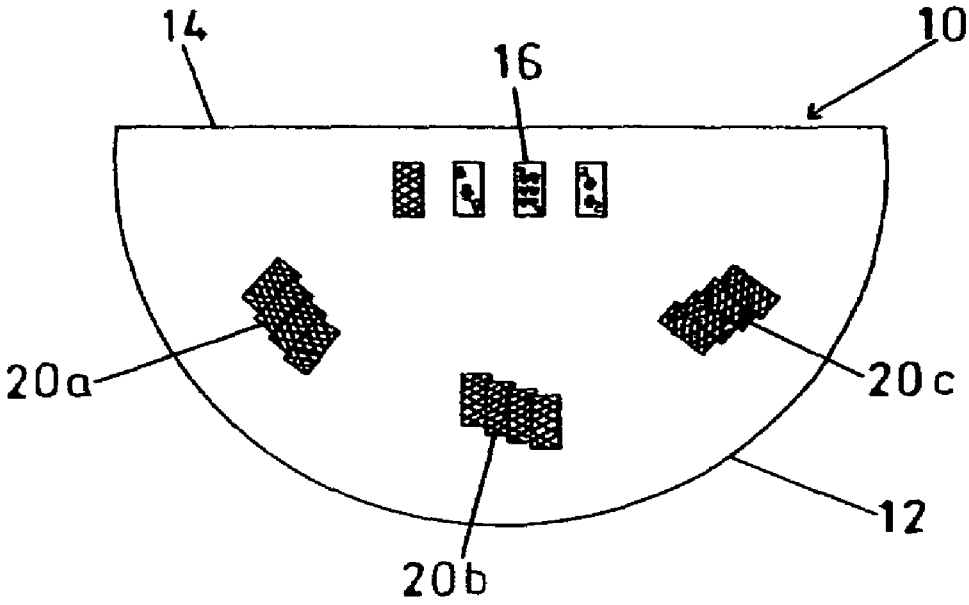
FIG. 5 is a plan view of a playing surface depicting the layout of a playing surface at the commencement of the third round of play.

FIG. 5 depicts said playing surface 10 at the commencement of the third round, wherein one of the community cards formerly with its face disposed toward the playing surface 10 is positioned with its faces opposite the playing surface, leaving 3 community cards being disposed with their respective faces disposed opposite the playing surface 10, and one community card being disposed with its face toward the playing surface. The first active player to the left of the person placing the minimum bet in the prior round is designated as the person to initiate betting in the present round. If the person designated to initiate betting in this round folds, the first player in turn wishing to stay in the game must place the minimum wager established for this round. Play proceeds in a clockwise manner with each remaining active player in turn exercising the option to call the minimum wager or any raised wager in that round, raise the minimum wager or any other raised wager in that round, or fold by placing his or her hole cards with the respective faces disposed toward the playing surface, into the center of the playing surface 10. Once all wagers have been called in this round, the round of play concludes. If only one active player remains at the end of this round, that player is declared the winner of the game. If more than 1 active player remains, play proceeds to the fourth round.

Figure 6:
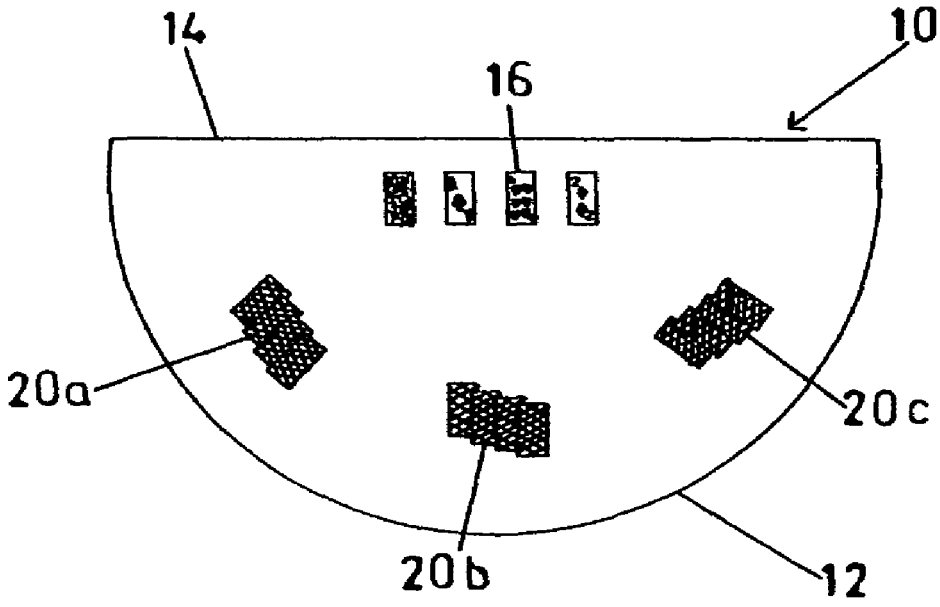
FIG. 6 is a plan view of a playing surface depicting the layout of a playing surface at the commencement of the fourth round of play.

FIG. 6 depicts said playing surface 10 at the commencement of the fourth round, wherein the final community card formerly with its face being disposed toward the playing surface 10 is now positioned with its face being disposed opposite the playing surface, leaving all four community cards being disposed with their respective faces disposed opposite the playing surface 10. The first active player to the left of the person placing the minimum bet in the prior round is designated as the person to initiate betting in the present round. If the person designated to initiate betting in this round folds, the first player in turn wishing to stay in the game must place the minimum wager established for this round. Play proceeds in a clockwise manner with each remaining active player in turn exercising the option to call the minimum wager or any raised wager in that round, raise the minimum wager or any other raised wager in that round, or fold by placing his or her hole cards with the respective faces disposed toward the playing surface, into the center of the playing surface 10. Once all wagers have been called in this round, play concludes. If there is only one active player remaining at the end of the final round, that player is declared the winner of the game.

If more than 1 active player remains, a showdown is held, wherein the all active players at the conclusion of play reveals his or her hole cards. Each player presents his or her hole cards with the respective faces disposed opposite the playing surface 10. A winner is determined as that active player with the highest ranking 5-card poker hand created from the 8 cards comprising that active player's four hole cards and the four community cards. The player with the highest 5-card poker hand is declared the winner, and receives the proceeds of the pot.

It will be appreciated by those having ordinary skill in the art that the method of playing a modified game of poker can be played as a house-banked or player-banked game, and can incorporate a progressive jackpot. Further, the method of playing a modified game of poker can be adapted for play in an electronic gaming device.

As can easily be seen, the method of playing a modified game of poker of the present invention provides a method that is easy to learn, increases the skill necessary to play when compared to other variations, can be easily adapted to a house-banked, player-banked, or electronic gaming device version, and can be varied by the number of hole cards or community cards or both without the necessity of changing the rules of play.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method for a playing modified game of stud Poker wherein players bet against each other utilizing a betting scheme to enhance strategy and player risk within each round, said method comprising the steps of:

Providing a standard deck of 52 playing cards;

Providing a playing surface;

Determining a player who will initiate betting in a first round of betting;

Determining a minimum wager for each of a first, second, third, and fourth round of betting;

Prior to a first round of betting, dealing an initial hand of four cards from said deck to each player, with the face of said cards being disposed toward said playing surface;

Prior to a first round of betting, arranging a set of four community cards from said deck so that the faces of the first 3 of said community cards are disposed toward the playing surface and the last of said community cards to be dealt, with the face being disposed opposite the playing surface;

Providing for a first round of betting wherein said player determined to initiate betting for a first round must either place an initial bet equal to said minimum wager for said first round of betting, or fold;

Continuing a first round of betting proceeding with the next player to the left of said player determined to initiate betting for a first round, wherein each player in turn must either place an initial bet if all players prior to him or her have folded, call an initial bet made by a previous better, raise any previously placed bet by increments of said minimum wager for said first round of betting, or fold;

Providing that the third card dealt into said community now be arranged with its face disposed opposite the playing surface;

Providing for a second round of betting wherein betting is initiated by the first active player remaining in the game seated to the left of said player determined to initiate betting for said first round of betting, with said player either placing a bet equal to said minimum wager for said second round of betting, or folding;

Continuing said second round of betting proceeding with the next active player to the left of said player initiating betting for said second round, wherein each active player in turn must either place the minimum bet for said second round if all players prior to him or her have folded, call a bet made by a previous better, raise any previously placed bet by increments of said minimum wager for said second round of betting, or fold;

Providing that the second card dealt into said community now be arranged with its face disposed opposite the playing surface;

Providing for a third round of betting wherein betting is initiated by the first active player remaining in the game seated to the left of said player initiating betting in said second round of betting, with said player either placing a bet equal to said minimum wager for said third round of betting, or folding;

Continuing said third round of betting proceeding with the next active player to the left of said player initiating betting for said third round, wherein each active player in turn must either place the minimum bet for said third round if all players prior to him or her have folded, call a bet made by a previous better, raise any previously placed bet by increments of said minimum wager for said third round of betting, or fold;

Providing that the first card dealt into said community be arranged with its face disposed opposite the playing surface:

Providing for a fourth round of betting wherein betting is initiated by the first active player remaining in the game seated to the left of said player initiating betting in said third round of betting, with said player either placing a bet equal to said minimum wager for said fourth round of betting, or folding;

Continuing said fourth round of betting proceeding with the next active player to the left of said player initiating betting for said fourth round, wherein each active player in turn must either place the minimum bet for said fourth round if all players prior to him or her have folded, call a bet made by a previous better, raise any previously placed bet by increments of said minimum wager for said fourth round of betting, or fold;

Determining a winner by examining the active player's 5-card poker hand established by using that player's 4 hole cards and the 4 community cards to determine a poker hand ranking thereof.

2. A method of playing a modified game of poker as set forth in claim 1, wherein the minimum wager is increased in each successive round of betting by a common factor or variable.

3. A method of playing a modified game of poker as set forth in claim 1, wherein a player wishing to raise a wager must do so in increments equal to that of that round's predetermined minimum wager.

* * * * *